US007212196B2

(12) United States Patent
Nakamura et al.

(10) Patent No.: US 7,212,196 B2
(45) Date of Patent: May 1, 2007

(54) LIQUID CRYSTAL DISPLAY DEVICE AND METHOD OF DRIVING THE SAME

(75) Inventors: Norio Nakamura, Ishikawa-ken (JP); Hiroyuki Sakurai, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 529 days.

(21) Appl. No.: 10/673,635

(22) Filed: Sep. 30, 2003

(65) Prior Publication Data

US 2004/0119677 A1 Jun. 24, 2004

(30) Foreign Application Priority Data

Sep. 30, 2002 (JP) ..... P2002-287859

(51) Int. Cl.

| | |
|---|---|
| ***G09G 5/00*** | (2006.01) |
| *G09G 3/36* | (2006.01) |
| *G09G 3/30* | (2006.01) |
| *G09G 3/32* | (2006.01) |

(52) U.S. Cl. ..... 345/213; 345/76; 345/83; 345/88; 345/89; 345/99; 345/690

(58) Field of Classification Search ..... 345/76–100, 345/211–213, 690–693

See application file for complete search history.

(56) References Cited

U.S. PATENT DOCUMENTS

| | | | | |
|---|---|---|---|---|
| 6,702,407 | B2 * | 3/2004 | Azami | 305/204 |
| 6,879,310 | B2 * | 4/2005 | Nose | 345/88 |
| 7,034,797 | B2 * | 4/2006 | Maki | 345/100 |

* cited by examiner

*Primary Examiner*—Alexander Eisen
(74) *Attorney, Agent, or Firm*—Pillsbury Winthrop Shaw Pittman, LLP

(57) ABSTRACT

A display device includes color display pixels, a driving circuit, and signal lines X1, X2 and X3. The driving circuit is provided with a reference gray scale signal circuit, a digital-to-analog conversion circuit and a signal supply circuit. The signal supply circuits provides signal lines X1, X2 and X3 with analog signals as video signals when reference gray scale signals are outputted in accordance with color characteristics of the pixels. The signal supply circuit also provides signal lines X1, X2 and X3 with preliminary analog video signals converted in response to the reference gray scale signals corresponding to color characteristics of other pixels when video signals are supplied to other signal lines during each horizontal scanning period.

9 Claims, 5 Drawing Sheets

LIQUID CRYSTAL DISPLAY DEVICE AND METHOD OF DRIVING THE SAME

FIELD OF THE INVENTION

This invention generally relates to a color liquid crystal display device and a method of driving the same and, more particularly, to a color display device to display images by switching reference gray scale signals in response to color characteristics and a method of driving the same.

BACKGROUND OF THE INVENTION

Flat panel display devices are widely used as those for personal computers, handy information processing equipment, television receivers, etc. Recently, display devices using light-emitting elements such as organic EL (electroluminescence) elements have attracted considerable attention and have been actively researched and developed. Organic EL display devices have the following features: (1) they do not need a rear light source that would prevent them from being made thin in thickness and light in weight, (2) they are suitable for the reproduction of moving images because of a rapid response characteristic, and (3) they can be used in cold locations because their brightness remains substantially unchanged in low temperatures.

The organic EL display devices are provided with display elements disposed in a matrix form to emit red, blue and green light. The display element consists of an anode, a cathode and a light-emitting layer. Materials for the light-emitting layer each are selected in accordance with wave lengths of the colors to be emitted.

It is necessary to drive each color in the organic EL display device in response to its light-emitting characteristics. It is known that a color can be driven by using different reference gray scale signals to match with the light emitting characteristics. Usually, a reference gray scale signal circuit is provided exclusively for every color to supply an output signal to its corresponding digital-to-analog conversion circuit.

In the display device video signals are generally written successively on a time-sharing basis for a horizontal display period. In order to carry it out successfully, the driving method has limitations with respect to display panel size, the number of pixels, integrated circuit (IC) performance, etc.

SUMMARY OF THE INVENTION

An object of the present invention is to provide a display device which is driven by using reference gray scale signals corresponding to colors of display pixels, respectively, and in which a writing period of time is sufficiently secured to write video signals in signal lines.

According to one aspect of the present invention, a display device is provided with display pixels disposed in a matrix form to display color images, driving circuits to drive the display pixels, and first, second and third signal lines to connect the display pixels to the driving circuits.

The driving circuits include a reference gray scale signal circuit to sequentially provide a predetermined number of reference gray scale signals in accordance with color characteristics of the display pixels when writing operations are carried out on the signal lines during each horizontal scanning period, a digital-to-analog conversion circuit to convert digital video signals supplied to the display pixels in response to the reference gray scale signals to analog signals, and a signal supply circuit to provide the analog signals to the first, second and third signal lines.

The signal supply circuit provides the analog signal to the first signal lines as video signals when the reference gray scale signals are supplied in response to the color characteristics of the display pixels and outputs the analog signals to the second and third signal lines as preliminary video signals when the video signals are supplied to the second and third signal lines in each scanning period.

A second aspect of the present invention is characterized in that the reference gray scale signal circuit includes resisters to divide power source voltages to output the reference gray scale signals and switches to select the resisters in accordance with the color characteristics.

A third aspect of the invention is characterized in that the reference gray scale signal circuit outputs the reference gray scale signals in order of their potentials from a lower one to a higher one.

A fourth aspect of the invention is characterized in that a display device includes first, second and third display pixels regularly disposed in a matrix form to display first, second and third color images, respectively, first, second and third signal lines connected to the first, second and third display pixels, respectively, first, second and third reference gray scale signal circuits to output first, second and third reference gray scale signals corresponding to the first, second and third color images, respectively, a digital-to-analog conversion circuit to convert digital video signals corresponding to the signal lines to analog signals in response to the reference gray scale signals, and a signal supply circuit to supply the analog signals to the signal lines as video signals.

The signal supply circuit includes a first switch to connect the first signal line to the digital-to-analog circuit during a first period during which the first reference gray scale signal is outputted, a second switch to connect the second signal line to the digital-to-analog circuit during a second period during which the second reference gray scale signal is outputted, and a third switch to connect the third signal line to the digital-to-analog circuit during a third period during which the third reference gray scale signal is outputted.

A fifth aspect of the invention is characterized in that the first period is longer than the second or third period.

A sixth aspect of the invention is characterized in that the first reference gray scale signal is smaller in potential than the second reference gray scale signal and the second reference gray scale signal is smaller in potential than the third reference gray scale signal.

According to the present invention, a method of driving a display device comprises disposing first, second and third display pixels regularly in a matrix form to display first, second and third color images, respectively; connecting first, second and third signal lines to the first, second and third display pixels, respectively; outputting first, second and third reference gray scale signals corresponding to the first, second and third color images, respectively; making a digital-to-analog conversion circuit convert digital video signals corresponding to the signal lines to analog signals in response to the first, second and third reference gray scale signals; supplying the analog signals to the signal lines as video signals; connecting the first, second and third signal lines to the digital-to-analog circuit during a first period during which the first reference gray scale signal is outputted; connecting the second and third signal lines to the digital-to-analog circuit during a second period during which the second reference gray scale signal is outputted; and connecting the third signal line to the digital-to-analog circuit during a third period during which the third reference gray scale signal is outputted.

Further, the method of driving a display device set forth above in which the reference gray scale signal circuit selects the reference gray scale signals with overlapping periods between the first and second period, the second and third periods and the third and first periods, respectively.

The method of driving a display device set forth above is characterized in that the reference gray scale signal circuit outputs the reference gray scale signals in order of potentials thereof from a lower one to higher one.

This patent application is based upon and claims the benefit of priority from the Japanese Patent Application No. 2002-287859, filed on Sep. 30, 2002, the entire contents of which are incorporated herein by reference.

BRIEF DESCRIPTION OF THE DRAWINGS

A more complete appreciation of the present invention and many of the attendant advantages thereof will be readily obtained as the same becomes better understood by reference to the following detailed descriptions when considered in connection with the accompanying drawings, wherein.

DETAILED EXPLANATION OF THE PREFERRED EMBODIMENTS

A 17-inch diagonal organic EL display device according to an embodiment of the present invention will be explained below with reference to the drawings.

Figure 1:
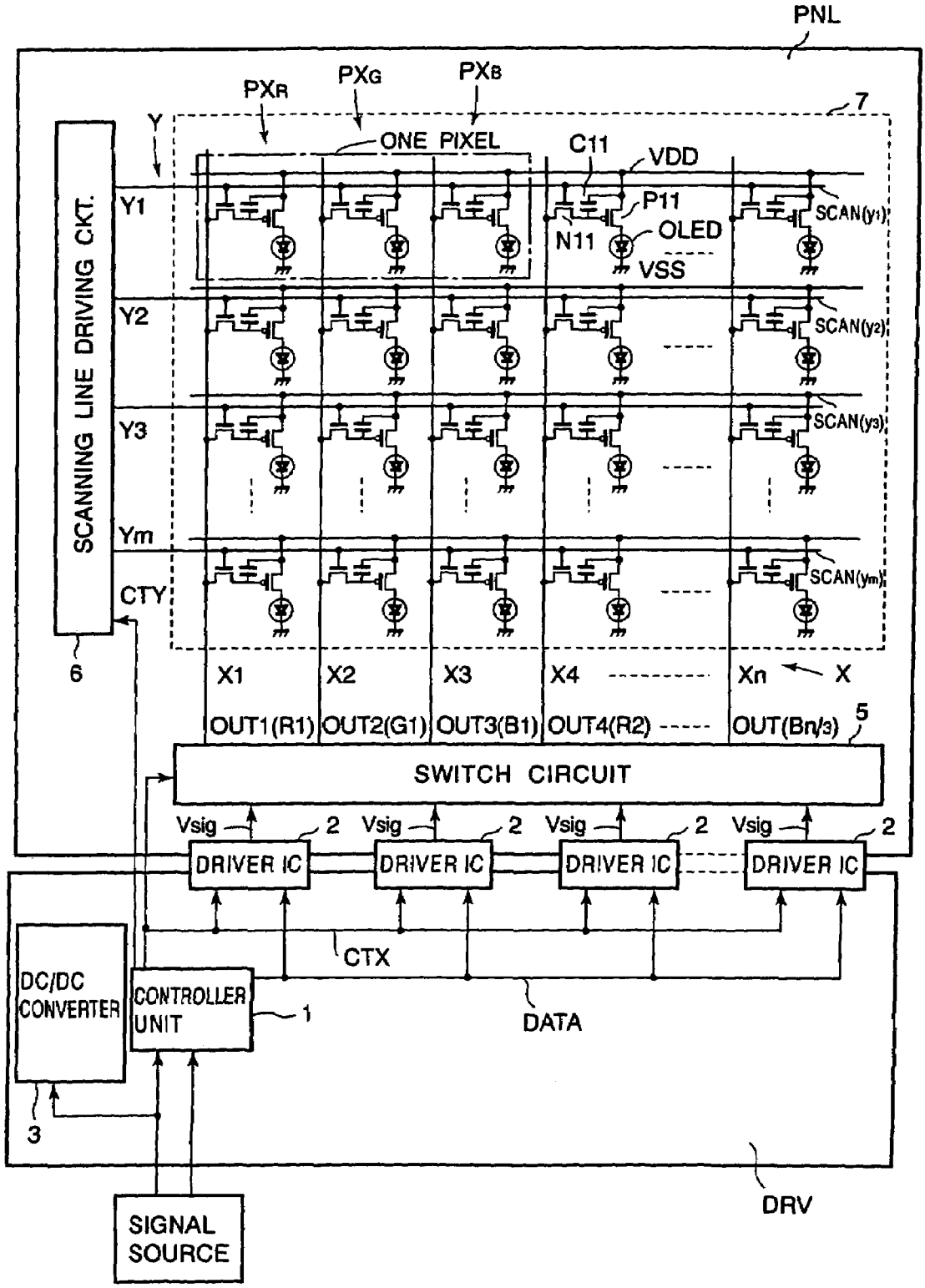
FIG. 1 is a block diagram of an organic EL display device of the present invention.
Figure 2:
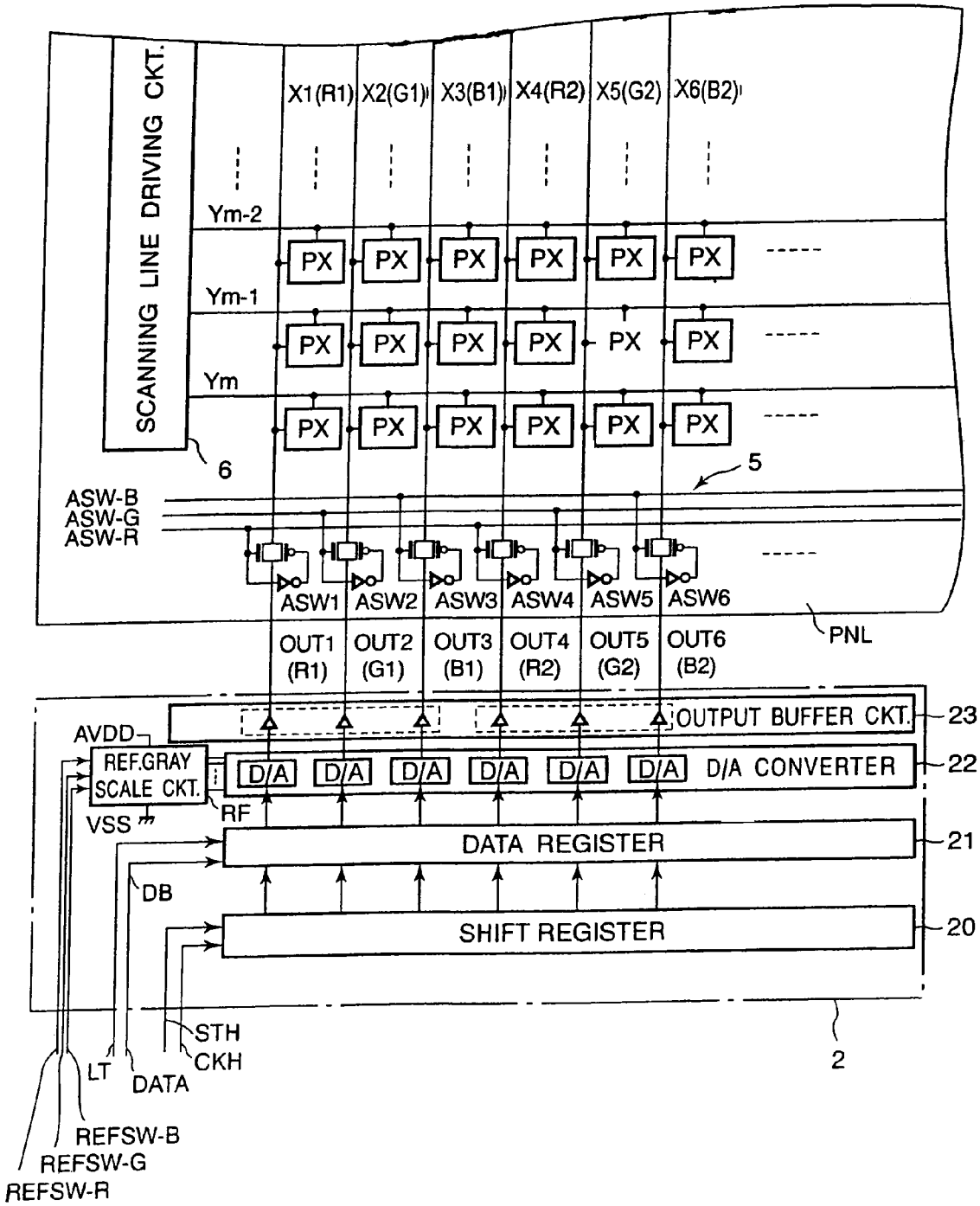
FIG. 2 is a block diagram of a driver and a signal line driving circuit shown in FIG. 1.

FIG. 1 is a block diagram of the organic EL display device. FIG. 2 is a block diagram of a driver and a switch circuit shown in FIG. 1. The organic EL display device is provided with an organic EL panel PNL and an outer driving circuit DRV.

The outer driving circuit DRV includes controller unit 1, drivers 2, and DC/DC converter 3. Controller unit 1 receives data from signal sources of personal computers, etc., generates control signals to drive the organic EL panel PNL and digitally processes to rearrange video signals. Drivers 2 convert digital video signals DATA into analog video signals Vsig. DC/DC converter 3 generates power source voltages to drive drivers 2 and organic EL panel PNL. Organic EL panel PNL includes switch circuit 5, scanning line driving circuit 6 and display region 7.

Color pixels are provided on display region 7 in a matrix form. Scanning lines Y1, Y2, . . . , and Ym (individually or collectively called "Scanning line(s) Y") are provided along lines of the pixels, respectively, and signal lines X1, X2, . . . , and Xn (individually or collectively called "Signal line(s) X") are provided to cross scanning lines Y at substantially right angles.

Color pixels consist of three, color display pixels $PX_R$, $PX_G$ and $PX_B$ (individually or collectively "Color display pixel(s) PX") emitting light with the wavelengths corresponding to red, green and blue, respectively. Signal line X is connected to the same color display pixels PX in row. Color display pixel PX includes switching element N11, electronic capacitor C11, driving circuit P11, and organic EL device OLED. Switching element N11 is, for example, an N-channel type thin film transistor connected between signal and scanning lines X and Y. Electronic capacitor C11 is provided to hold video signal voltages. Driving circuit P11 is, for example, a P-channel type thin film transistor to drive organic EL device OLED. Cathode and anode of organic EL device OLED are connected to the reference potential (ground) VSS and the drain electrode of driving circuit P11, respectively. The gate electrode of driving circuit P11 is connected to the drain electrode of switching element N11 while the source electrode of driving circuit P11 is connected to power source line VDD. The source and gate electrodes of switching element N11 are connected to signal and scanning lines X and Y, respectively. Further, electronic capacitor C11 is connected between power source line VDD and the gate electrode of driving circuit P11 and the drain electrode of switching element N11.

Controller unit 1 generates various control signals such as vertical scanning control signal CTY and horizontal scanning control signal CTX. Vertical scanning control signal CTY includes a vertical start pulse signal generated every vertical scanning period and vertical clock pulse signals. The number of the vertical clock pulse signals per vertical scanning period corresponds to that of scanning lines Y. Horizontal scanning control signal CTX includes horizontal start pulse signal STH per horizontal scanning period, horizontal clock pulse signals CKH and latch signals LT. The number of horizontal clock pulse signals CKH per horizontal scanning period corresponds to that of signal lines X. Latch signals LT control timings for data register 21 to latch and output digital video signals which are supplied from controller unit 1 to signal lines X and subjected to serial-to-parallel conversions. Vertical scanning control signal CTY is provided from controller unit 1 to scanning line driving circuit 6. Horizontal scanning control signal CTX and digital video signal DATA are provided from controller unit 1 to drivers 2.

Scanning line driving circuit 6 shifts the vertical start pulse signal in synchronization with the vertical clock pulse signal to successively supply gate driving signals SCAN (Y1), SCAN(Y2), SCAN(Y3), . . . , SCAN(Ym) (individually or collectively called "SCAN") to scanning lines Y.

As shown in FIG. 2, drivers 2 are in the form of integrated circuits provided on a flexible printed circuit board connecting organic EL panel PNL to outer driving circuit board DRV (shown in FIG. 1). Drivers 2 include buses DB, shift register 20, data register 21, digital-to-analog (D/A) converter circuit 22, reference gray scale signal circuit RF and output buffer circuit 23. Buses DB receive digital video signals DATA. Shift register 20 shifts horizontal start pulse signal STH in synchronization with horizontal clock pulse signal CKH. Data register 21 converts serial digital video signals DATA on buses DB into parallel ones in response to output signals from shift register 20 and successively receives and holds them. Data register 21 outputs such parallel digital video signals DATA to D/A converter circuit 22 in accordance with latch signals LT. D/A converter circuit 22 convert digital video signals DATA into analog ones. Reference gray scale signal circuit RF provides a predetermined number of reference gray scale signals VREF (i.e., voltages V0–V9) to D/A converter circuit 22. Output buffer circuit 23 amplifies analog electric currents from D/A converter circuit 22 to output video signals Vsig through switch circuit 5.

Figure 3:
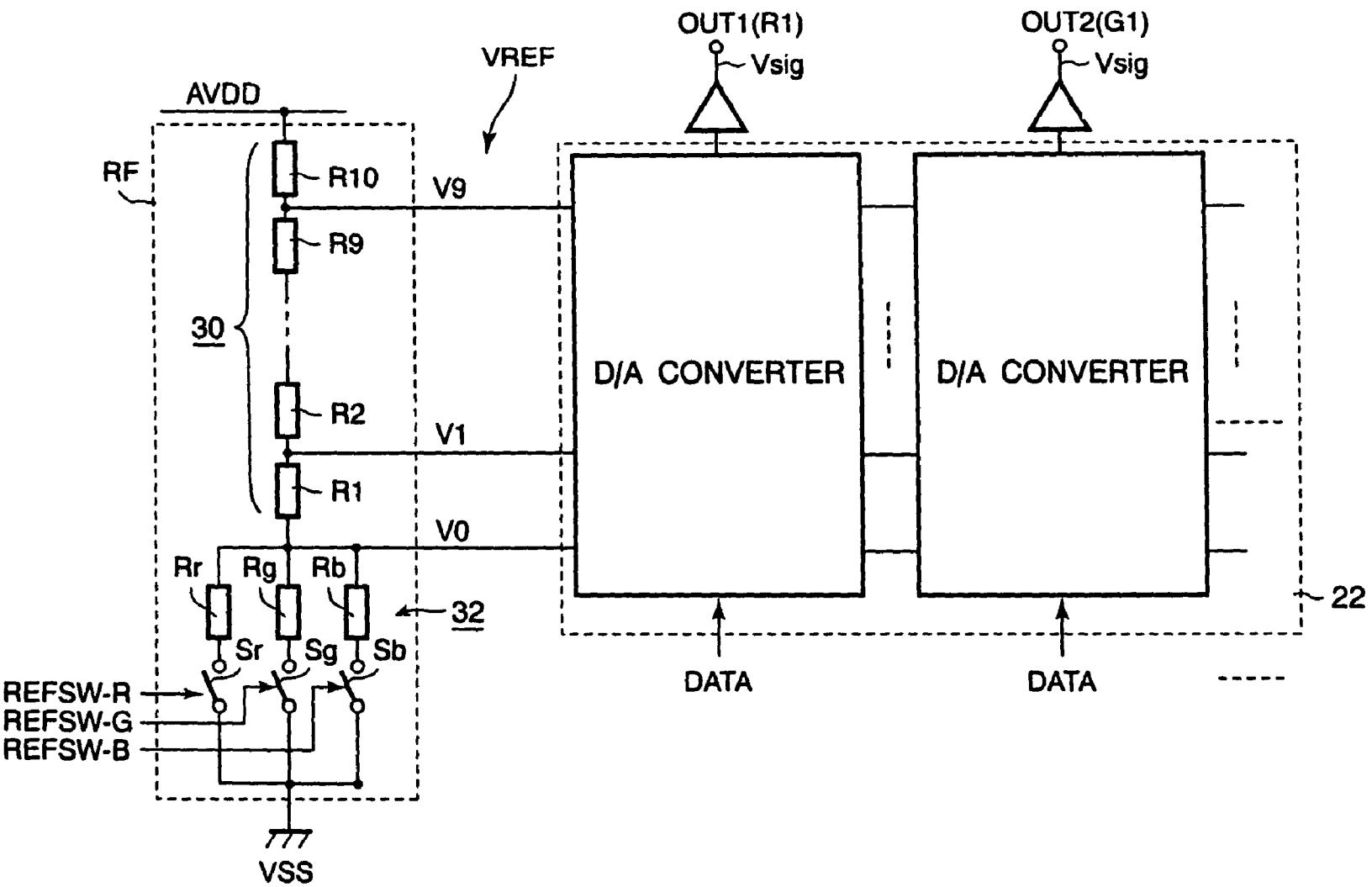
FIG. 3 is a circuit diagram of a reference gray scale signal circuit shown in FIG. 2.

D/A converter circuit 22 is provided with D/A converters (so called "R-DAC") that convert digital video signals DATA into analog ones in response to reference gray scale signals. As shown in FIG. 3, reference gray scale signal circuit RF includes ladder resister 30 and resister switching circuit 32. Ladder resister 30 consists of a series of resisters R1–R10 while resister switching circuit 32 consists of gray scale resisters Rr, Rg and Rb and switches Sr, Sg and Sb connected in series with the resisters Rr, Rg and Rb. A series circuit of ladder resister 30 and resister switching circuit 32 is connected between first and second power supply lines AVDD and VSS. Thus, a voltage between power supply lines AVDD and VSS is divided by the ladder resister 30 and the reference gray scale resisters of resister switching circuit 32 to generate a predetermined number of reference gray scale voltages VREF. Switches Sr, Sg and Sb are sequentially controlled in response to resister selection signals REFSW-R, REFSW-G and REFSW-B generated by controller unit 1 for red, green and blue colors, respectively. When switch Sr is turned on, for instance, the voltage provided between power supply lines AVDD and VSS is divided by gray scale resister Rr and resisters R1–R10 to generate reference gray scale signal VREF for the red color. Subsequently, when switch Sg is turned on, the voltage provided between power supply lines AVDD and VSS is divided by gray scale resister Rg and resisters R1–R10 to generate reference gray scale signal VREF for the green color. Further, when switch Sb is turned on, the voltage provided between power supply lines AVDD and VSS is divided by gray scale resister Rb and resisters R1–R10 to generate reference gray scale signal VREF for the blue color.

Referring now FIG. 2, switch circuit 5 is connected between output terminals OUT1, OUT2, . . . , and OUTn/3 of output buffer circuit 23 and signal lines X1, X2, X3, . . . , and Xn (shown in FIG. 1) and includes analog switches ASW1, ASW2, ASW3, . . . , and ASWn (also shown in FIG. 1) controlled in response to switching control signals ASW-R, ASW-G and ASW-B generated from controller unit 1 as part of horizontal scanning control signal CTX. Each of analog switches ASW1, ASW2, ASW3, . . . , and ASWn is a transfer gate consisting of P-channel and N-channel thin film transistors. The gate electrode of the N-channel transistor is connected to the gate electrode of the P-channel transistor through an inverter. Switching control signals ASW-R, ASW-G and RSW-B each are supplied to their common lines. In short, switching control signal ASW-R is provided to control terminals of analog switches ASW1, ASW4, ASW7, . . . connected to the signal lines for the red color. Similarly, switching control signal ASW-G is provided to control terminals of analog switches ASW2, ASW5 and ASW8, . . . connected to the signal lines for the green color. Further, switching control signal ASW-B is provided to control terminals of analog switches ASW3, ASW6, ASW9, . . . connected to the signal lines for the blue color.

Here, explanations of various periods will be made. An effective video period is the one from the time when all the analog switches are turned on to that when they are tuned off. A horizontal blanking period is defined as the period from the time when a blanking period ends to that when a next effective video period starts. A horizontal scanning period is the sum of an effective video period and a blanking period.

Figure 4:
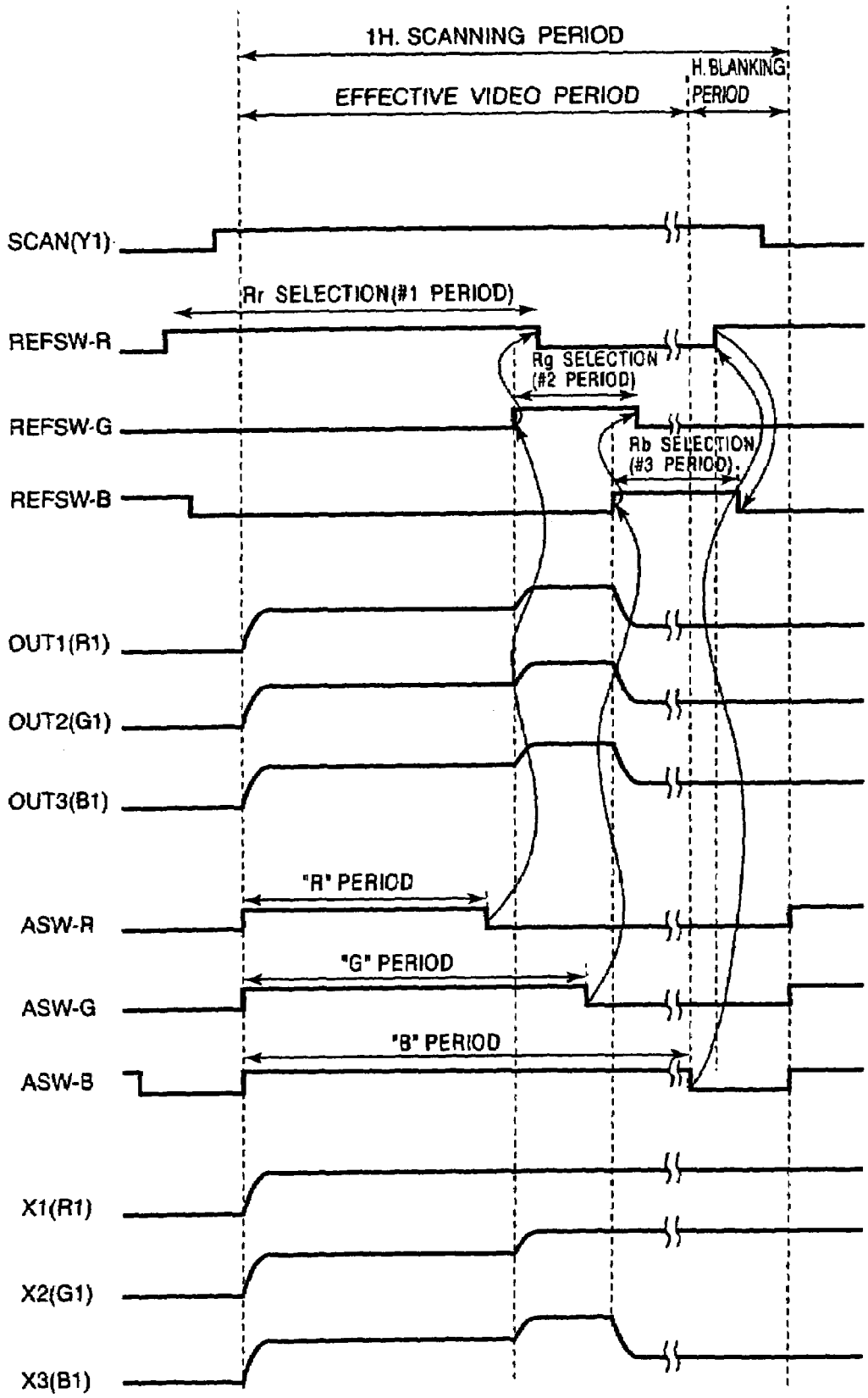
FIG. 4 is an operation time chart of the organic EL display device shown in FIG. 1.

With reference to FIG. 4 showing operation time charts of the organic EL display device, video signals are written sequentially in red, green and blue display pixels PXr, PXg and PXb (shown in FIG. 1), i.e., only a unit of color display pixel PX, during a horizontal scanning period. When gate driving signal SCAN(Y1) is supplied from scanning line Y1 to select display pixels, resister selection signal REFSW-R and switching control signals ASW-R, ASW-G and ASW-B are selected (turned on) so that their "R", "G" and "B" periods commence and all the signal lines X and the output buffer circuit 23 are enabled during a first period of resister selection signal REFSW-R when the reference gray scale signal VREF (shown in FIG. 3) is selected for the red color. Video signal Vsig, subjected to a digital-to-analog (D/A) conversion in accordance with reference gray scale signal VREF for the red color, is written in display pixels through switch circuit 5 and signal lines X1, X2 and X3. In other words, the video signal Vsig is written not only in red display pixel PXr but, at the same time, also in green and blue display pixels PXg and PXb, respectively, as a preliminary video signal. After the video signal Vsig is supplied to each of the signal lines, only switching control signal ASW-R comes down and does not select the red analog switch so that the period "R" of the operation to write the video signal Vsig in signal line X1 for the red color is completed. In a predetermined period of time after switching control signal ASW-R comes down, resister selection signal REFSW-G for the green color rises up, switch Sg for the green color is selected, resister selection signal REFSW-R for the red color comes down, and switch Sr is in a non-selected state.

After resister selection signal REFSW-R for the red color comes down, an output of reference gray scale signal circuit RF is set to be a reference gray scale signal for the green color. That is, a second period of resister selection signal REFSW-R starts when reference gray scale signal VREF is selected for the green color. Thus, digital video signals are converted into analog signals Vsig by the D/A converter in accordance with the reference gray scale for the green color during that period of time. Video signal Vsig is then commonly provided to output terminals OUT1, OUT2 and OUT3 and signal lines X2 and X3 because analog switches ASW2 and ASW3 are enabled. Thus, video signal Vsig is written not only in green display pixel PXg but, at the same time, also in the blue display pixel PXb as a preliminary video signal. Switching control signal ASW-G then comes down and does not select the green analog switch so that the period "G" of the operation to write the video signal Vsig on signal line X2 for the green color is completed. In a predetermined period of time after switching control signal ASW-G comes down, resister selection signal REFSW-B for the blue color rises up, switch Sb for the blue color is selected, resister selection signal REFSW-G for the green color comes down, and switch Sg is in a non-selected state.

After resister selection signal REFSW-G for the green color comes down, an output of reference gray scale signal circuit RF is set to be a reference gray scale signal for the blue color. A third period of resister selection signal REFSW-B starts when reference gray scale signal VREF is selected for the blue color. Digital video signals are converted into analog video signal Vsig by the D/A converter in accordance with the reference gray scale for the blue color during that period of time. Video signal Vsig is commonly provided to output terminals OUT1, OUT2 and OUT3 and signal line X3 through enabled analog switch ASW3. Thus, the video signal Vsig is provided to the blue display pixel PXb only. Switching control signal ASW-B then comes down and does not select the blue analog switch so that the period "B" of the operation to write the video signal in signal line X3 for the blue color is completed. In a predetermined period of time after switching control signal ASW-B comes down, resister selection signal REFSW-R for the red color rises up, switch Sr for the red color is selected, resister selection signal REFSW-B for the blue color comes down, and switch Sb is in a non-selected state.

During the horizontal blanking period electrical potentials on signal lines X1, X2 and X3 are held at red, green and blue pixels PXr, PXg and PXb, respectively, when scanning signal SCAN(Y1) comes down. Organic EL element OLED emits red, green and blue light with the applicable brightness in response to such electrical potentials.

As set forth above, the present invention is directed to a method of controlling the display device which includes display pixel matrix arrays, signal lines, reference gray scale signal circuits, a digital-to-analog conversion circuit and signal supply circuits. First, second and third color display pixels are regularly disposed in the display pixel matrix arrays. The signal lines consist of first, second and third signal lines provided each commonly at rows of the first, second and third color display pixels. When video signals are written in any or all of the first, second or third signal lines, preliminary video signals subjected to D/A conversions in accordance with reference gray scale signals are applied to predetermined signal lines in advance. The reference gray scale signal circuit sequentially supplies first, second and third reference gray scale signals corresponding to first, second and third color display pixels. The D/A conversion circuit converts digital video signals supplied to the signal lines in accordance with outputs from the reference gray scale signal circuit into analog video signals. Th signal supply circuits provide the analog video signals from the D/A conversion circuit to the signal lines. The signal supply circuit controls the display device to connect the first through third signal lines to the D/A conversion circuit for the first period during which the first reference gray scale signal is outputted, the second and third signal lines to the D/A conversion circuit for the second period during which the second reference gray scale signal is outputted, and the third signal lines to the D/A conversion circuit for the third period during which the third reference gray scale signal is outputted. The preliminary video signals are identical with data of the regular video signals to be written but different in reference gray scale signals from the same at the digital-to-analog conversion. Thus, after the preliminary video signals are written on the signal lines, video signal writing operations are completed by only carrying out adjustments of the reference gray scale signals. In this way, since the preliminary video signals are being written on the signal lines during the period of time when the regular video signals are in the writing process on other signal lines, it takes only a short time to sufficiently write the regular video signal after switching the reference gray scale signals. The setting of writing operation time, therefore, is longer for the first regular video signal during each horizontal scanning period than for other regular video signals. In short, the setting of writing op ration time is properly adjustable in accordance with color characteristics.

The present invention is also applicable to large signal line load panels, e.g., even more than 10-inch diagonal display panels which are difficult to drive on a time sharing basis of effective video periods since rise time of video signals at writing can be shortened according to the present invention to sufficiently execute the writing operation.

Further, even where the number of display pixels increases, the present invention can provide display panels with good display quality.

In the event that the method of the present invention is adopted, choices for driving capability of integrated circuits (ICs) are widened so that the writing operation can be properly executed by ICs with even lower driving capability and that production costs can be significantly lowered, accordingly.

Since the reference gray scale signals are switched after a predetermined period of time from turning off the analog switches, signal line potentials are applied on more stabilized conditions.

Further, since the reference gray scale signal circuit switches the reference gray scale signals with their overlapped periods, undesired fluctuations of its output can be suppressed.

Figure 5:
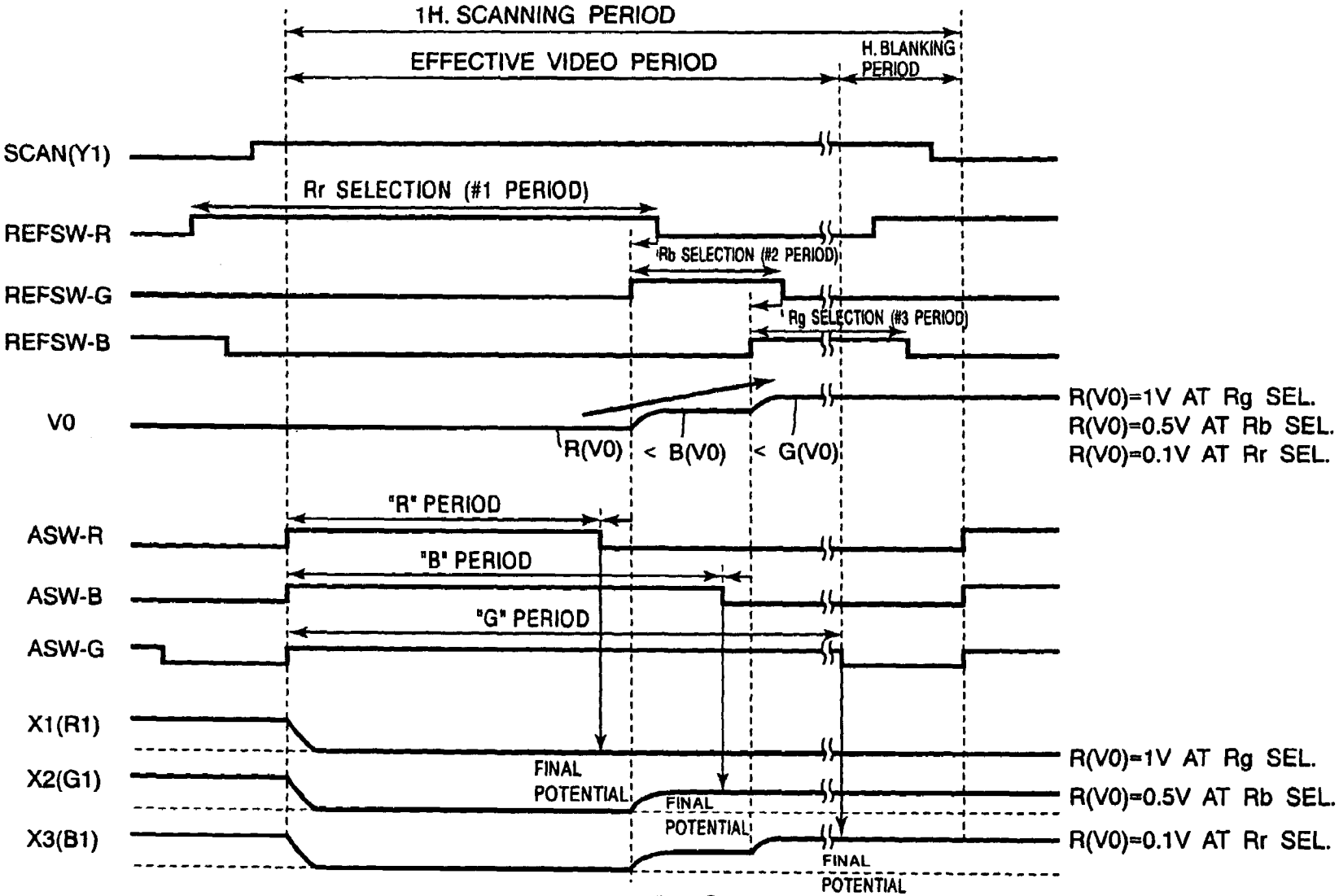
FIG. 5 is an operation time chart of a modified version of the organic EL display device shown in FIGS. 1–3.

FIG. 5 describes operation charts of a modified version of the organic EL display device shown in FIGS. 1–3. Reference gray scale signal circuit RF (shown in FIG. 3) generates a predetermined number of the reference gray scale signals for red, green and blue colors in its selections of reference resisters Rr, Rg and Rb, respectively. The reference gray scale signals are set in accordance with material characteristics of the light emitting layer but the change from a lower potential to a higher one for IC operations can make writing operation time short. For that purpose it is desirable to match a writing order of video signals on the signal lines to IC output characteristics. Here, if the lowest voltages R(V0), G(V0) and B(V0) of reference gray scale signals for the red, green and blue colors are satisfied with R(V0)<B(V0)<G(V0), controller unit 1 rearranges digital video signals DATA so that D/A converter circuit 22 converts digital video signals DATA into analog video signals in the order of the red, blue and green colors. In addition, the rising-up order of resister selection signals REFSW-R, REFSW-G and REFSW-B is changed to that of resister selection signals REFSW-R, REFSW-B and REFSW-G. Similarly, the rising-up order of switching control signals ASW-R, ASW-G and ASW-B is also changed to that of switching control signals ASW-R, ASW-B and ASW-G. In the example shown in FIG. 5, R(V0)=0.1V, B(V0)=0.5V and G(V0)=1V. As seen from such example, signal line X3 (shown in FIG. 1) rises up from a potential corresponding to the video signal for the red color and reaches that corresponding to the video signal for the blue color. Also, signal line X2 rises up from a potential corresponding to the video signal for the red color, reaches that corresponding to the video signal for the blue color and that corresponding to the video signal for the green color.

With this structure, since signal lines X2 and X3 are always driven preliminarily to change potentials in upper directions, it can avoid unnecessary changes in potential of signal lines X2 and X3. Thus, it achieves low power consumption as well as short driving time.

Obviously many modifications and variations to the present invention are possible in light of the above teachings. It is therefore to be understood that within the scope of the appended claims the invention may be practiced otherwise than as specifically described. For example, the present invention is applicable not only an organic EL display device but also a liquid crystal display device. In such a liquid crystal display device, a color display can be made by disposing color filters on its display surface and reference gray scale signals are switched to match color characteristics of the color filters.

Instead of generating a predetermined number of voltages by reference gray scale signal circuit RF as set forth above, that of electric current can be provided in the case of an electric current control system. Further, although analog switches ASW1–ASWn of switch circuit 5 each consist of transfer gates of P-channel and N-channel thin film transistors, they may consist of single N-channel thin film transistors if they function as analog switches.

According to the present invention, a display device is driven by applying reference gray scale signals in response to color characteristics so that it can be provided with a great degree of design freedom.

What is claimed is:

1. A display device comprising:

display pixels disposed in a matrix form to display color images;

driving circuits to drive said display pixels; and first, second and third signal lines to connect said display pixels to said driving circuits;

wherein said driving circuits include a reference gray scale signal circuit to sequentially provide a predetermined number of reference gray scale signals in accordance with color characteristics of said display pixels when writing operations are carried out on said signal lines during each horizontal scanning period, a digital-to-analog conversion circuit to convert digital video signals supplied to said display pixels in response to said reference gray scale signals to analog signals; and a signal supply circuit to provide said analog signals to said first, second and third signal lines;

wherein said signal supply circuit provides said analog signals to said first signal lines as video signals when said reference gray scale signals are supplied in response to said color characteristics of said display pixels and outputs said analog signals to said second and third signal lines as preliminary video signals when said video signals are supplied to said second and third signal lines in each scanning period.

2. The display device according to claim 1, wherein said reference gray scale signal circuit includes:

resisters to divide power source voltages to output said reference gray scale signals; and switches to select said resisters in accordance with said color characteristics.

3. The display device according to claim 1, wherein said reference gray scale signal circuit outputs said reference gray scale signals in order of potentials thereof from a lower one to higher one.

4. A display device comprising:

first, second and third display pixels regularly disposed in a matrix form to display first, second and third color images, respectively;

first, second and third signal lines connected to said first, second and third display pixels, respectively;

first, second and third reference grayscale signal circuits to output first, second and third reference gray scale signals corresponding to said first, second and third color images, respectively;

a digital-to-analog conversion circuit to convert digital video signals corresponding to said first, second and third signal lines to analog signals in response to the reference gray scale signals; and a signal supply circuit to supply said analog signals to said signal lines as video signals;

wherein said signal supply circuit includes:

a first switch to connect said first signal line to said digital-to-analog conversion circuit during a first period during which said first reference gray scale signal is outputted;

a second switch to connect said second signal line to said digital-to-analog circuit during said first period and a second period during which said second reference gray scale signal is outputted; and a third switch to connect said third signal line to said digital-to-analog circuit during said first and second periods and a third period during which said third reference gray scale signal is outputted.

5. The display device according to claim 4, wherein said first period is longer than said second or third period.

6. The display device according to claim 4, wherein said first reference gray scale signal is smaller than said second reference gray scale signal and said second reference gray scale signal is smaller than said third reference gray scale signal.

7. A method of driving a display device comprising:

disposing first, second and third display pixels regularly in a matrix form to display first, second and third color images, respectively;

connecting first, second and third signal lines to said first, second and third display pixels, respectively;

outputting first, second and third reference grayscale signals corresponding to said first, second and third color images, respectively;

making a digital-to-analog conversion circuit convert digital video signals corresponding to said signal lines to analog signals in response to said first, second and third reference gray scale signals;

supplying said analog signals to said signal lines as video signals;

connecting said first, second and third signal lines to said digital-to-analog circuit during a first period during which said first reference gray scale signal is outputted;

connecting said second and third signal lines to said digital-to-analog circuit during a second period during which said second reference gray scale signal is outputted; and connecting said third signal line to said digital-to-analog circuit during a third period during which said third reference gray scale signal is outputted.

8. The method of driving a display device according to claim 7, wherein said reference gray scale signal circuits elects said reference gray scale signals with overlapping periods between said first and second period, said second and third periods and said third and first periods, respectively.

9. The method of driving a display device according to claim 7, wherein said reference gray scale signal circuit outputs said reference gray scale signals in order of potentials thereof from a lower one to higher one.

* * * * *